15-299
10/15/85 4,546,514

United States Patent [19]

Tutino

[11] Patent Number: 4,546,514

[45] Date of Patent: Oct. 15, 1985

[54] CLEANING PAD HOLDER

[76] Inventor: Dominick J. Tutino, 26 Kawin Ave., Hawthorne, N.J. 07506

[21] Appl. No.: 432,684

[22] Filed: Nov. 21, 1983

[51] Int. Cl.[4] ..... A47L 25/00

[52] U.S. Cl. ..... 15/209 D

[58] Field of Search ..... 15/209 R, 209 B, 209 C, 15/209 D, 147 R, 147 C, 149, 150, 151; 294/100

[56] References Cited

U.S. PATENT DOCUMENTS

| | | | |
|---|---|---|---|
| 1,438,794 | 12/1922 | Tudor | 15/209 D |
| 2,786,223 | 3/1957 | Ziskind | 15/209 D |
| 3,100,311 | 8/1963 | Tutino | 15/209 D |

FOREIGN PATENT DOCUMENTS

| | | | |
|---|---|---|---|
| 677503 | 8/1952 | United Kingdom | 294/100 |

*Primary Examiner*—Edward L. Roberts
*Attorney, Agent, or Firm*—Auslander & Thomas

[57] ABSTRACT

This cleaning pad holder is designed to clampingly grip a steel wool or other type pad, so as to clean or polish kichen utensils or other articles, without the user injuring his or her fingers in doing so. The device includes a cylinder, which serves as a handle grip, and a sleeve on its interior, serves as a plunger to operate the jaws that grip the pad, the jaws being of a spring clamp secured to the sleeve.

2 Claims, 7 Drawing Figures

FIG. 1
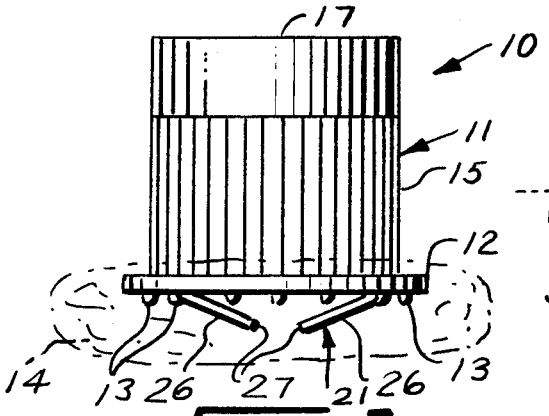
FIG. 2
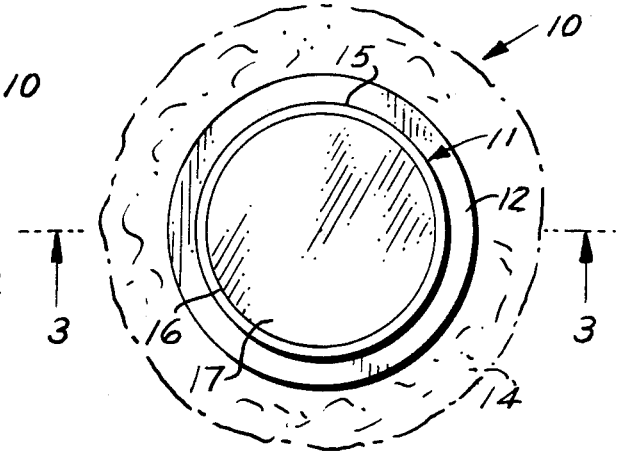
FIG. 3
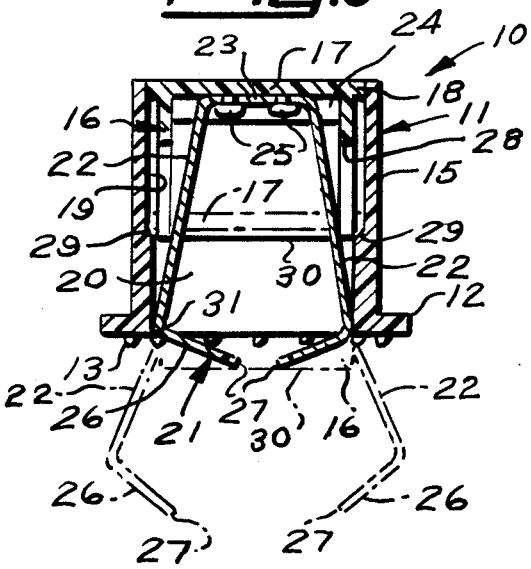
FIG. 4
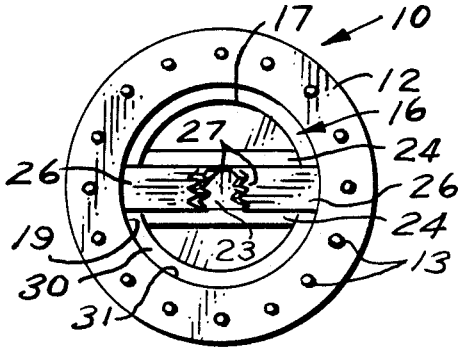
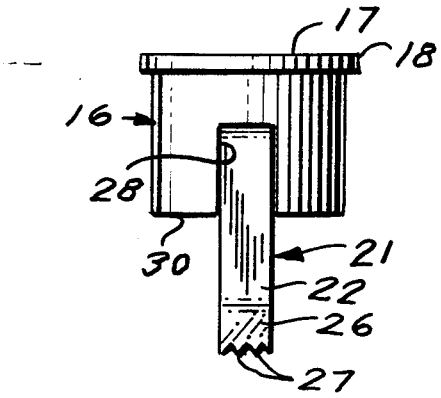
FIG. 5
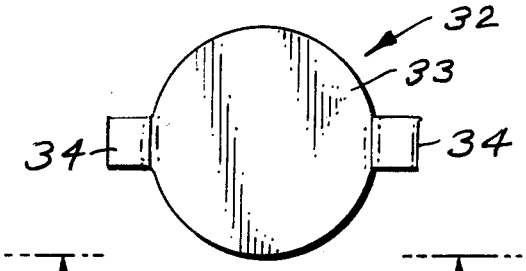
FIG. 6
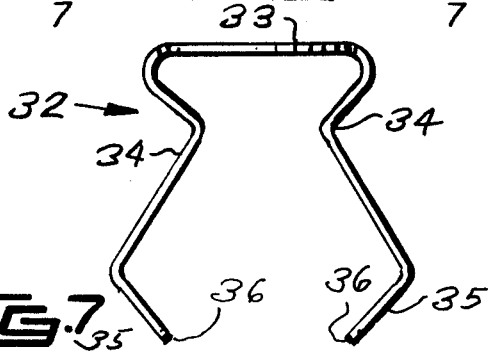
FIG. 7

CLEANING PAD HOLDER

This invention relates to kitchen devices, and more particularly, to a cleaning pad holder.

The principal object of this invention is to provide a cleaning pad holder, which will be an improvement over the Dominick J. Tutino U.S. Pat. No. 3,100,311, filed Sept. 25, 1962, and issued Aug. 13, 1963.

Another object of this invention is to provide a cleaning pad holder, which will be employed for use with soap-impregnated steel wool pads, glass wool, or other pads having fiberous materials therein.

Another object of this invention is to provide a cleaning pad holder, which will prevent the user from injuring their fingers when using pads, such as steel wool and the like, and the device will be such structure, so as to enable the user to clean a utensil or other articles, with a minimum of effort and in a minimum amount of time.

A further object of this invention is to provide a cleaning pad holder, which will be adaptable for holding cloth pads as well.

Other objects of the invention are to provide a cleaning pad holder, which will be simple in design, inexpensive to manufacture, rugged in construction, and easy to operate.

These and other objects will become readily understood, upon a study of the specification and the accompanying drawing in which:

FIG. 1 is a side view of the present invention, shown in operative use use, and in elevation, and a steel wool pad is shown in phantom;

FIG. 2 is a top plan view of FIG. 1;

FIG. 3 is a cross-sectional view, taken along the line 3—3 of FIG. 2, showing the pad removed therefrom, and illustrates the jaws in the downward release position, in phantom;

FIG. 4 is a bottom plan view of the invention, showing the jaws in retracted position;

FIG. 5 is a side view of the jaw and sleeve combination, shown in elevation and removed therefrom;

FIG. 6 is a top plan view of a modified form of plunger and jaw, for the cylinder of the invention, and FIG. 7 is a view taken along line 7—7 of FIG. 6.

Accordingly, a holder device 10 is shown to include a hollow plastic cylinder 11, which is open at both ends, and includes an integrally attached and annular, extending flange 12. Flange 12 serves as a base, and is provided with a plurality of radially spaced nipples 13, which are integrally attached thereto, for gripping into a typical pad 14, that will be used to clean and polish kitchen utensils and other articles. The outer periphery 15 of cylinder 11, is knurled at the lower portions thereof, so as to enable the user to easily grip cylinder 11, without the user's hand slipping, and a plastic sleeve 16, includes an end wall 17, integral therewith, which has an annular flange 18, that is in sliding engagement with the inner periphery 19 of the bore 20 of cylinder 11. A leaf type spring 21, having a pair of legs 22, is received between a pair of parallel spaced ribs 24, that are integrally attached to the underside of end wall 17, and center portion 23 is fixedly secured to end wall 17, by means of nipples 25, formed in a pair of openings through portion 23, however, portion 23 may be secured to end wall 17, in suitable manner known in the art. The legs 22 of spring 21, normally urge outwards away from each other, by the inherent characteristics of spring steel, from which it is fabricated, and the lower portions of legs 22 are terminated by inwardly disposed and oppositely opposed jaw portions 26, having a plurality of teeth 27, for gripping and retaining pad 14 when device 10 is in use, as is readily seen, particularly, in FIG. 1 of the drawing. A pair of oppositely opposed and elongated cut-outs 28, are included through the wall of sleeve 16, so as to receive legs 22 of spring 21, when sleeve 16 is urged downward by the user's finger, to extend jaw portions 26 into open position for grippingly engaging pad 14, or releasing pad 14 after it has been used and is to be disposed of.

A slightly rounded shoulder 29, is also provided on the inner periphery 19 of cylinder 11, so as to serve as stop means, against further downward travel of the bottom rim 30 of sleeve 16, when sleeve 16 is pushed down by the user, thus preventing the accidental discharge of the sleeve 16 and spring 21 combination from device 10, and it shall also be noted, that upon returing legs 22 of spring 21 and the attached sleeve 16, to their full upward position, the peripheral edge 31 at the bottom of cylinder 11, serves as a cam which by engagement with the outside of legs 22, will urge legs 22 together on their upward travel, so as to grip and retain pad 14.

It shall further be noted that when rim 30 is at the area of the shoulder 29, a slight pressure exists against rim 30, which is not readily apparent in the drawing, however, this slight pressure causes rim 30 to remain at that point with the end wall 17 flush with the top of cylinder 11, when spring 21 is retracted into cylinder 11, and when sleeve 16 is pushed downward by the user, the rim 30 overcomes this slight holding, and continuous on downward to expand the jaw portions 26.

In operation, the user grasps the cylinder 11 in one hand, and with his forefinger urges downward on end wall 17, which causes legs 22 to spread and extend partially out of the flange 12 area. When this is accomplished the flange 18 of sleeve 16, will stop against shoulder 29. The user then places the jaw portions 26 over a pad 14, and then urges device 10 downwards which will cause the teeth 27 of jaw portions 26, to engage with the pad 14 and simultaneously, the edge 31 of cylinder 11, will cam close the jaw portions 22 on the pad 14. After the above is accomplished, the user can then easily clean or polish a utensil or other article.

Referring now to FIGS. 6 and 7 of the drawing, a modified spring 32, consists of a circular center portion 33, having a pair of legs 34 integrally attached thereto, and extending angularly inward at their upper extremities. The lower portions extend outwards and are terminated by inwardly extending jaw portions 35, having a plurality of teeth 36, for gripping and retaining a pad 14. Spring 32 is adapted to be received in cylinder 11, but does not require a sleeve, as was heretofore described of device 10.

In operation, spring 32 functions in the same manner, as was heretofore described of the spring 21, however, it is urged downwards by finger pressure upon the center portion 33, which serves as surface means for its operation.

While various changes may be made in the detail construction, such details will be within the spirit and scope of the present invention, as defined by the appended claims:

I claim:

1. A cleaning pad holder comprising a plastic generally cylindrical body having an axial bore therein open at its bottom end, a plunger slidable in said bore and having a lower end projectable from said open end, said bore having an annular radially inwardly projecting rib thereon, said plunger having its lower portion guidably and slidably received in said rib and having an annular flange on its upper portion slidable in said bore and engageable with said rib for limiting downward sliding of said plunger in said bore, and said plunger being a hollow plastic cylinder; said plunger having an end wall; and a pair of spaced apart ribs substantially parallel to each other inside said plunger on said end wall, a leaf spring; said leaf spring having a center portion; legs; said legs biased apart; jaws opposed to each other and extending beyond the bottom rim of said plunger; and said jaws having teeth, said leaf spring center portion affixed to said end wall between said ribs, a pair of cutouts in said plunger; said cutouts opposite each other and terminating at said bottom rim; and said cutouts aligned with said ribs and adapted to receive the legs of said leaf spring extending therethrough, said legs retrievable into said plunger, actuating means engageable with said legs upon retractive movement of said plunger into said body for effecting movement of said jaws toward each other whereby they may be embedded and retained in a cleaning pad for securing said pad to the bottom end of said cleaning pad holder, said actuating means comprising a cam surface on the inner periphery of said cylindrical body engaging said legs and resiliently and radially compressing said pad into said plunger upon upward movement of said plunger into said bore.

2. The invention of claim 1 wherein said leaf spring is affixed by means of nipples passing through openings in said center portion of said leaf spring.

* * * * *